US011223151B2

(12) United States Patent
Underwood et al.

(10) Patent No.: US 11,223,151 B2
(45) Date of Patent: Jan. 11, 2022

(54) ELECTRICAL CONNECTOR WITH TRANSLATIONALLY MOVABLE ELECTRICAL CONTACTS AND MAGNETIC RETAINING ELEMENT

(71) Applicant: IFPL Group Limited, Isle of Wight (GB)

(72) Inventors: Geoffrey Paul Underwood, Isle of Wight (GB); John Michael Wright, Isle of Wight (GB); Mark Tyler Reed, Isle of Wight (GB)

(73) Assignee: IFPL GROUP LIMITED, Isle of Wight (GB)

( * ) Notice: Subject to any disclaimer, the term of this patent is extended or adjusted under 35 U.S.C. 154(b) by 0 days.

(21) Appl. No.: 15/016,483

(22) Filed: Feb. 5, 2016

(65) Prior Publication Data

US 2017/0229801 A1 Aug. 10, 2017

(51) Int. Cl.

| | |
|---|---|
| ***H01R 11/30*** | (2006.01) |
| ***H01R 13/24*** | (2006.01) |
| ***H01R 13/04*** | (2006.01) |
| ***H01R 13/62*** | (2006.01) |

(52) U.S. Cl.

CPC ..... *H01R 13/2407* (2013.01); *H01R 13/04* (2013.01); *H01R 13/6205* (2013.01)

(58) Field of Classification Search

CPC ..... H01R 13/6205; H01R 23/7073; H01R 13/2407; H01R 13/04

USPC ..... 439/38–40, 660

See application file for complete search history.

(56) References Cited

U.S. PATENT DOCUMENTS

| | | | | |
|---|---|---|---|---|
| 3,363,214 A * | 1/1968 | Wright | H01R 13/6205 | 439/180 |
| 4,844,582 A * | 7/1989 | Giannini | G02B 6/3817 | 385/57 |
| 5,921,783 A * | 7/1999 | Fritsch | H01R 13/703 | 439/38 |
| 5,931,683 A | 8/1999 | Pinel | | |
| 7,329,128 B1 * | 2/2008 | Awad | H01R 13/6205 | 439/38 |
| 7,331,793 B2 * | 2/2008 | Hernandez | H01F 38/14 | 439/38 |
| 7,341,458 B1 * | 3/2008 | Koh | H01R 13/2421 | 439/39 |

(Continued)

FOREIGN PATENT DOCUMENTS

| | | |
|---|---|---|
| CN | 2227380 Y | 5/1996 |
| CN | 204732573 U | 10/2015 |

(Continued)

OTHER PUBLICATIONS

European Search Report issued in corresponding European Patent Application No. 17154707.8 dated Jun. 12, 2017.

(Continued)

*Primary Examiner* — Thanh Tam T Le

(74) *Attorney, Agent, or Firm* — Whiteford, Taylor & Preston, LLP; Peter J. Davis

(57) ABSTRACT

An electrical plug and socket having electrical contacts that are magnetically retained to the counterpart electrical contacts, where the electrical contacts may be optionally be mounted for translational movement, optionally including a sprung carrier arranged to provide a counter-force to at least one direction of translational movement.

22 Claims, 10 Drawing Sheets

(56) References Cited

U.S. PATENT DOCUMENTS

| | | | | |
|---|---|---|---|---|
| 7,645,143 | B2 * | 1/2010 | Rohrbach | H01R 13/6205 439/39 |
| 7,658,613 | B1 * | 2/2010 | Griffin | H01R 13/6205 439/39 |
| 7,775,801 | B2 * | 8/2010 | Shiff | H01R 13/6205 439/39 |
| 7,874,844 | B1 * | 1/2011 | Fitts, Jr. | H01R 13/6205 439/218 |
| 8,272,876 | B2 * | 9/2012 | Schultz | H01R 13/719 439/38 |
| 8,531,075 | B1 | 9/2013 | Moore | |
| 8,672,228 | B1 | 3/2014 | Saini | |
| 8,920,178 | B2 * | 12/2014 | Wei | G06F 1/1626 361/679.41 |
| 9,077,105 | B2 * | 7/2015 | Kim | H01R 13/2421 |
| 9,083,110 | B2 * | 7/2015 | McClelland | H01R 13/6205 |
| 9,196,979 | B2 * | 11/2015 | Kim | H01R 13/24 |
| 9,306,322 | B2 * | 4/2016 | Bhimavarapu | H01R 13/6205 |
| 10,096,938 | B2 * | 10/2018 | McClelland | H01R 31/06 |
| 2006/0145663 | A1 | 7/2006 | Shiff et al. | |
| 2007/0072443 | A1 | 3/2007 | Rohrbach et al. | |
| 2014/0057463 | A1 | 2/2014 | Bhimavarapu et al. | |
| 2014/0099808 | A1 | 4/2014 | McClelland | |
| 2014/0287601 | A1 | 9/2014 | Suh | |
| 2015/0093918 | A1 | 4/2015 | Underwood | |

FOREIGN PATENT DOCUMENTS

| | | |
|---|---|---|
| EP | 0152806 | 1/1985 |
| EP | 0289208 | 11/1988 |
| EP | 0867977 | 9/1998 |
| EP | 0887888 | 12/1998 |
| EP | 2469663 | 6/2012 |
| GB | 221783 A | 2/1925 |
| GB | 2533258 | 6/2016 |
| TW | 201345069 | 11/2013 |
| WO | 03/084004 | 10/2003 |

OTHER PUBLICATIONS

United Kingdom International Search Report issued in co-pending application No. GB1602135.4 dated Jun. 29, 2016.

Office Action issued in co-pending Chinese Application 2017101861872 dated Oct. 30, 2019.

Chinese Office Action issued in corresponding Chinese Patent Application No. 2017101861872 dated Aug. 17, 2020.

* cited by examiner

ELECTRICAL CONNECTOR WITH TRANSLATIONALLY MOVABLE ELECTRICAL CONTACTS AND MAGNETIC RETAINING ELEMENT

TECHNICAL FIELD

The present invention relates generally to electrical connectors, and in particular, although not exclusively, to plugs and jacks for use with electrical equipment, such as headsets.

BACKGROUND

Jack and plug connectors are known to enable user equipment, such as headphones, to be connected to host equipment, such as a passenger entertainment system. Whilst the plug is inserted in the jack it is possible that the user will move the headphones relative to the point of connection between the plug and the jack. If the user attempts to move the headphones beyond the length of the cable (which connects the plug to the headphones) a force will be applied to the plug and the jack by the cable. This means that the cable, the jack and/or the plug could be damaged as a result of the force applied. In extreme cases personal injury could result—tripping, lassoing etc.

We have realised that it would be advantageous to provide an improved electrical connector.

SUMMARY

According to the invention there is provided an electrical plug and an electrical socket.

According to a first aspect of the invention there is provided an electrical connector comprising two electrical contacts which provide an electrical connection for a counterpart electrical connector, the electrical contacts arranged to interface with counterpart electrical contacts of the plug, and said electrical contacts arranged to be magnetically retained to the counterpart connector when attached to the connector, and to carry electrical signals.

The connector of the first aspect of the invention may be termed a first connector, and the counterpart connector may be termed a second connector.

Each of the electrical contacts may be mounted for translational movement. The electrical contacts may be arranged to allow for and permit an extent of translational movement when connected to a plug. The electrical contacts are preferably located in so as to be able to float. Alternatively, the electrical contacts may be fixedly/immovably mounted in the connector.

The connector may comprise a sprung carrier arranged to provide a counter-force to at least one direction of translational movement. The sprung carrier may be described as a spring-biasing mechanism. The sprung carrier may be termed a sprung mounting.

The sprung carrier may provide electrical connection from the electrical contact.

The sprung carrier may comprise an electrically conductive pathway. The sprung carrier may comprise an electrically conductive material.

The sprung carrier may be arranged such that, in use, on initiating connection with a counterpart connector, the electrical contacts are translated against a spring force. The electrical contacts may be arranged to be translated outwardly of the connector. The electrical contacts may be translated outwardly of an interface of the connector. The sprung carrier may be arranged to provide a restoring force to the electrical contacts when the counterpart connector is decoupled/detached from the connector, the electrical contacts are urged to translate inwardly of the interface of said connector.

The electrical contacts may be arranged to be substantially flush with, or protrude from, a surrounding external interface surface when not connected to a counterpart connector.

The electrical contacts may be located intermediate of the pin receiving recesses. The electrical contacts may be substantially centrally located between the pin receiving recesses.

The electrical contacts may be spaced apart in a direction which is substantially orthogonal to the direction in which the pin receiving recesses are spaced.

The electrical contacts may each comprise a substantially cylindrical formation or portion. The cylindrical formation may be provided with an encircling shoulder. The shoulder may be arranged to engage with a sprung carrier. The shoulder may be of greater diameter than the cylindrical portion. It will be appreciated that the electrical contacts may be non-cylindrical, such as custom shaped or profiled.

The electrical contacts may comprise an electrically conductive magnetic or magnetised material.

The electrical contacts may be provided located in a region which is intermediate of the projections.

Each of the electrical contacts is connected to a signal carrying connection.

Each of the electrical contacts may be arranged to carry a respective electrical signal. Each of the electrical contacts may be arranged to carry an audio (drive) signal.

The connector may comprise four electrical contacts.

The connector may comprise at least two electrical pin-receiving recesses. The connector may comprise three pin receiving recesses.

Where four electrical contacts are provided, no electrical pin receiving recesses are provided (for connection to a counterpart connector).

The connector may comprise an electrical socket.

The counterpart connector may comprise a plug for electrical equipment comprising a housing and two electrical pins extending from an interface of the housing for receipt by a socket and for electrical connection therewith, and the plug further comprising two electrical contacts also arranged for electrical contact with the socket, wherein the pins are longer than the electrical contacts, wherein the projections arranged to facilitate disengagement of the plug from a socket, and further wherein the electrical contacts arranged to magnetically attract to the socket and thereby provide a magnetic retaining force between the plug and the socket, and the electrical contacts arranged to carry an electrical signal.

Where the plug is a plug for a headset, a respective two of the projections and the electrical contacts may be arranged to provide (positive and negative) circuitry connections for one of left- or right-speakers and the other two of the electrical contacts and the projections arranged to provide electrical circuitry connections for the other speaker.

The plug and/or socket may comprise one or more features in the detailed description and/or in the drawings, either singularly or in combination.

BRIEF DESCRIPTION OF THE DRAWINGS

Various embodiments of the invention will now be described, by way of example only, with reference to the following drawings in which.

DETAILED DESCRIPTION

Figure 1:
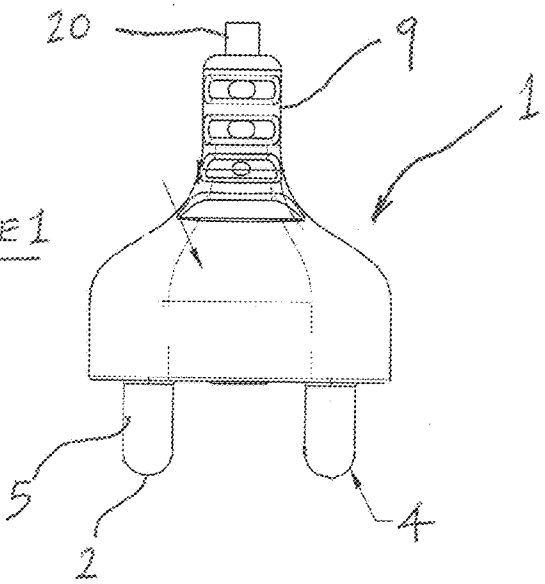
FIG. 1 is a plan view of an electrical plug.

With reference to FIG. 1, there is shown a plug 1 for electrical equipment comprising a housing, and two pins 4 and 5, extending front and front side, or interface, of the housing. As will be described below, the plug is advantageously arranged to facilitate ease of removal from a socket/jack 10. Of particular advantage is the fact that in the event that the user (for example the wearer of an audio headset connected to the plug) moves beyond the length of the cable 20 connecting the equipment to the plug, the plug can easily break away from its mating, in a quick-release manner, without causing damage to the plug or to the socket. The plug and the socket may more generally be referred to as a connector and a counter-part connector which are arranged to detachably mate, and when connected provided an electrical connection.

Each of the pins 4 and 5 provides electrical connection to respective contacts in the socket 10. The plug 1 is connected to a headphone apparatus wherein each pin provides short return or audio return.

Figure 4:
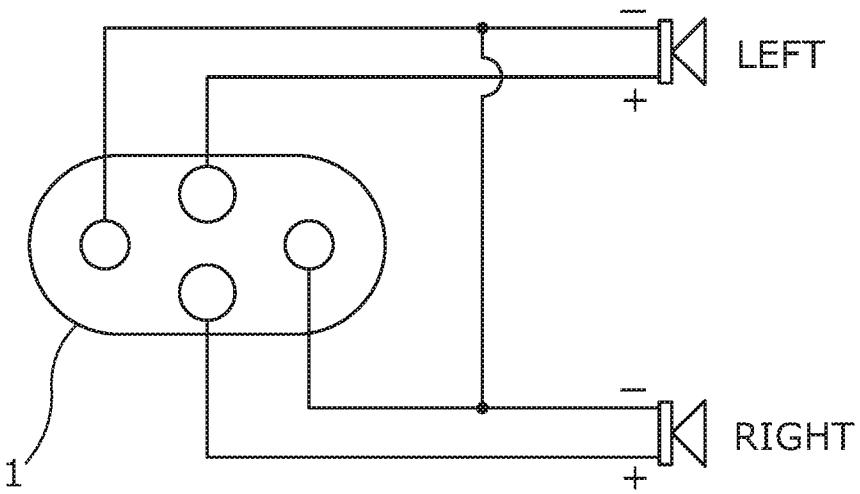
FIG. 4 is an electrical circuit schematic of the electrical plug of FIG. 1.

The plug 1 further comprises two electrical contacts 3*a* and 3*b*, also provided on the front (interface) surface of the plug 1, each is of squat, flat, profile. The electrical contacts 3*a* and 3*b* provide an electrical signal contact, and are fixedly mounted/embedded in the housing of the plug. The electrical contacts in use, carry electrical (audio) drive signals to the respective left and right speakers of a headset, and are connected to suitable internal wiring according. Reference is made to FIG. 4 which shows the electrical circuitry connections of the plug to the audio headset. Each of the contacts 3 is of substantially shorter length than the pins 4 and 5, and may be considered as having only negligible length as compared to the pins 4 and 5. The contacts 3 have substantially negligible length and each comprises a flat metal portion (and being magnetically attractive to a magnet) located intermediate of the pins 4 and 5. The contacts 3 are arranged for intimate, or face-to-face, electrical contact, which counterpart contacts provided by the socket 10.

It will be appreciated that the pins 4 and 5 are of shorter length as compared to those on a standard plug, such as the ARINC 628 standard. This, at least in part, assists removal of the plug from the socket. It is also to be noted that the distal ends or tips 2 of the each of the pins is rounded, or obround, and thereby further facilitating extraction of the pins from the socket 10. It will be appreciated however that the tips could be of a pointed construction as opposed to rounded.

Figure 5:
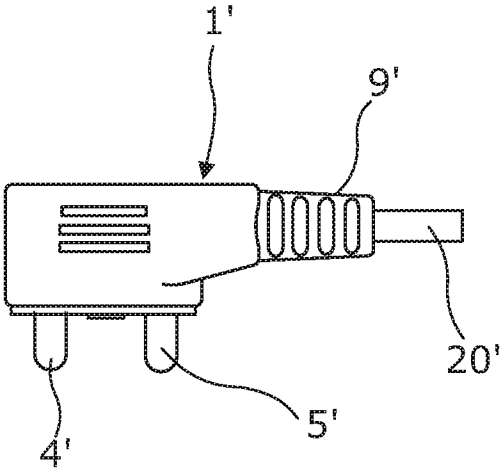
FIG. 5 is a plan view of a second embodiment of an electrical plug.
Figure 6:
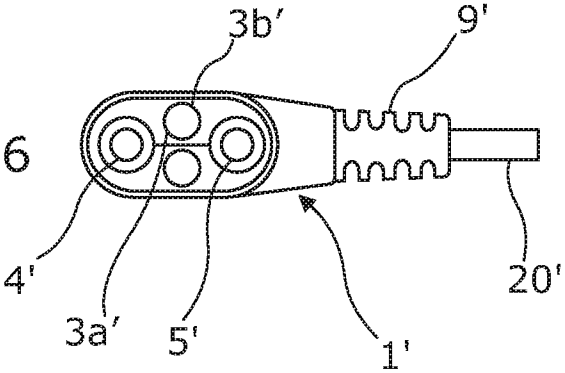
FIG. 6 is a front elevation of the electrical plug of FIG. 5.

Reference is made to FIGS. 5 and 6, which show a variant embodiment of the plug 1, comprising an electrical plug 1'. In this embodiment, a cable entry housing portion 9' is orientated substantially orthogonally to the pins 4' and 5', and therefore the cable 20' is also accordingly orientated.

The socket 10, or jack unit, comprises an (outer) housing 25, arranged to fit into a standard (or non-standard) aircraft aperture for an inflight passenger entertainment system. The housing 25 comprises a plug interface region 24 which is arranged to interface with the plug 1. The interface region 24 comprises a protuberance or boss which extends forwardly of the housing of the socket. The interface region comprises two apertures 6 and 7. The apertures 6 and 7 are arranged to receive respective pins 4 and 5 of the plug. An electrical contact arrangement is provided within each aperture (described in further detail below) and each is arranged to contact with a respective conductive portion of each pin, and provide suitable electrical signals thereto.

Figure 7:
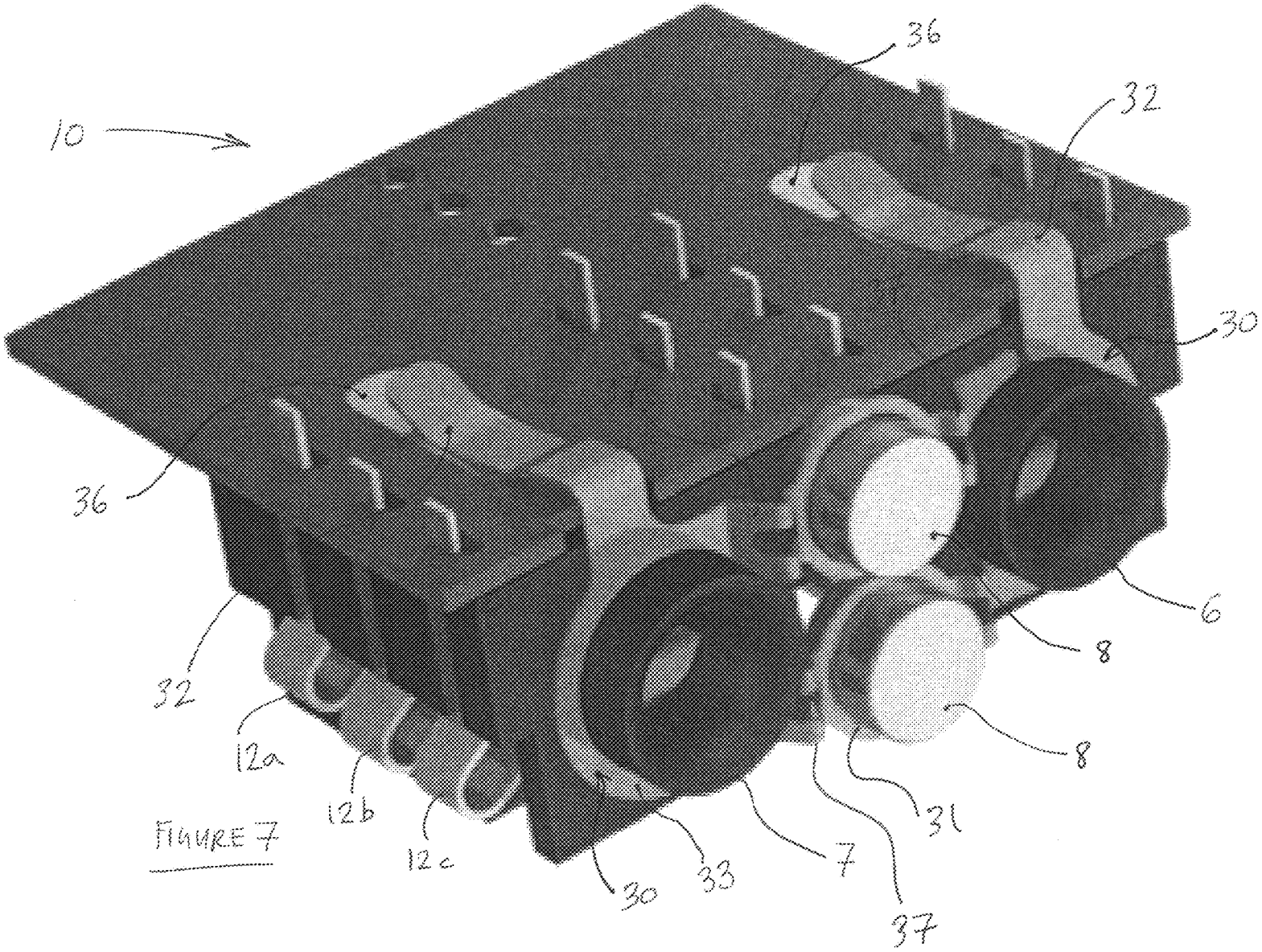
FIG. 7 is a perspective view of the innard sub-assembly of an electrical socket.
Figure 9:
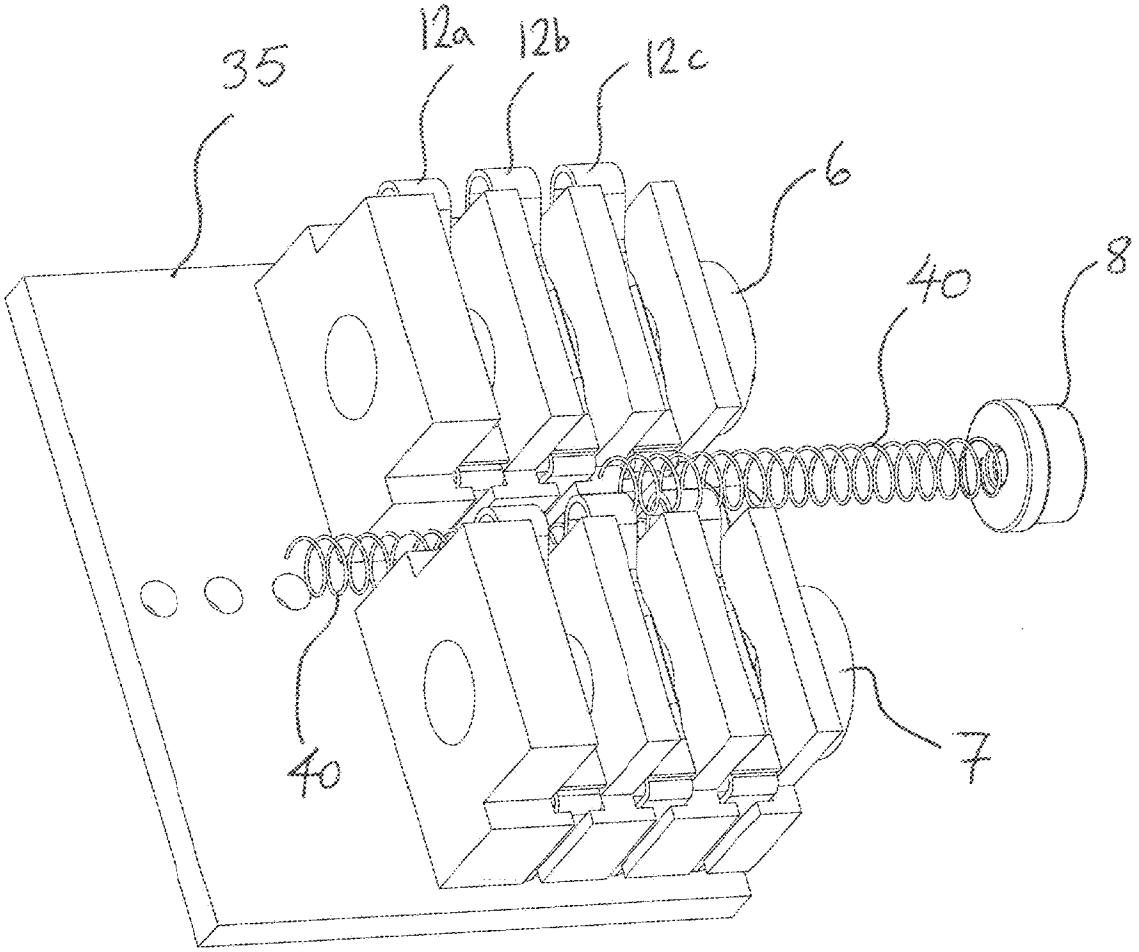
FIG. 9 is an exploded view of the electrical socket innard of FIG. 7.

With reference in particular to FIGS. 7 and 9, the socket 10 further comprises a sprung carrier 30. In overview, the sprung carrier serves the dual purpose of providing a restoring counter force to translational movement of each of the contacts 8, and serving to provide an electrical pathway to circuitry of the innard sub-assembly. Specifically, the sprung carrier comprises two annular portions 31, each arranged to receive a respective contact 8 in the aperture defined thereby. Each annular portion 31 arranged to engage with a shoulder portion 8*a* of each contact. Each contact 8 comprises a substantially cylindrical portion 8*a*, comprising a shoulder portion 8*b* (as best seen in FIG. 10).

The sprung carrier 30 further comprises two electrically conductive limbs 32 which are arranged to electrically connect the contacts 8 to the innard sub-assembly of the socket. A printed circuit board 35, which is part of the innard sub-assembly, is provided with electrical contact regions 36. Each of the limbs 32 is arranged to be in electrical connection with those regions. It will be appreciated that the sprung carrier 30 is made of an electrically conductive material such as a metal. The sprung carrier further comprises two formations 33 which are arranged to locate around each of the apertures 6 and 7. The spring action provided by the sprung carrier 30 is by way of suitably configured and dimensioned sprung hinges 37.

The use of the sprung carrier 30 advantageously facilitates assembly of the socket 10, since both spring mounting and electrical connectivity can be achieved in minimal assembly steps. Furthermore, the formations 33 serve to hold the carrier in place, since, as is described below, each of the magnetic electrical contacts 8 is of opposing poles, and so will be drawn together, which can hinder the assembly process. Therefore since the formations attach around each of the openings of recesses 6 and 7, the contacts are prevented from coming together.

Figure 10:
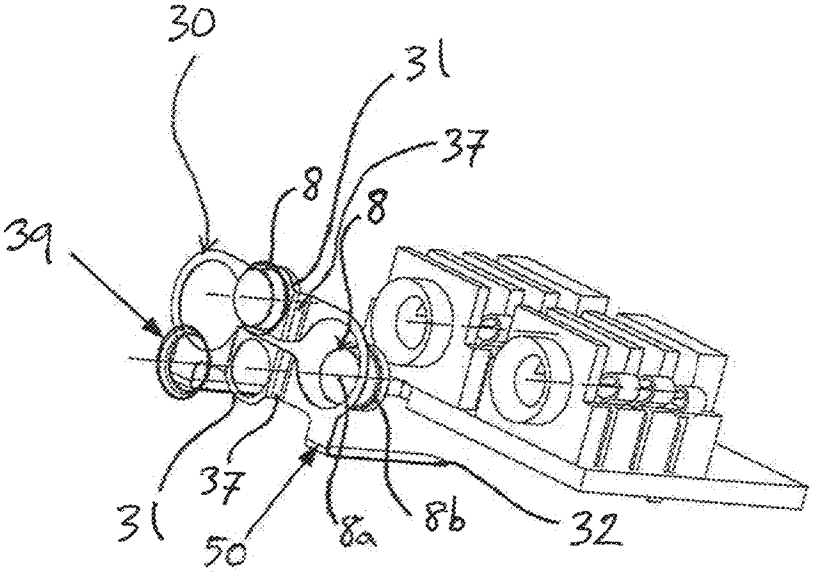
FIG. 10 is an exploded view of a variant electrical socket innard.

The embodiment shown in FIG. 10, although differing slightly from that shown in FIG. 7, in terms of structure somewhat, performs the same core functionality as the embodiment shown in FIG. 7. Component 39 is a sprung carrier which could be formed as a conical spring, a plastic moulding or a piece of resilient foam rubber. In this variant the contact frame 50 is a flexible substrate or Printed Circuit Board (PCB) material (instead of being made of metal, as per the above embodiment) where the contact tracks are printed/etched on the rear surface of a substrate such as polyester or Kapton tape. The frame 50 having a degree of spring and compliance. The return spring 39 acts not only to push the magnet back once the headset has released, it also pushes the membrane against the magnet to ensure good signal transmission.

FIG. 9 shows a variant sprung carrier in which a coil spring is used.

The use of a steel sprung carrier could be advantageous as it could be used to turn the electrical contacts into "pot magnets" thereby accentuating the magnetic field being thrown forward of the magnet. To improve the throw extent forwards of the magnetic field of the electrical contacts 8 we may have chance at some point to create a simple lamination ie a pot magnet, where a magnet is constructed with an Fe based backing material—this 'shorts' the flux, throwing it forward. The Fe component could be a simple plate or could be a bucket that pushes forward of the magnet to increase the strength tenfold. The Fe based bucket (very low carbon steel) is insulated from the periphery of the magnet by a plastic membrane.

Figure 9A:
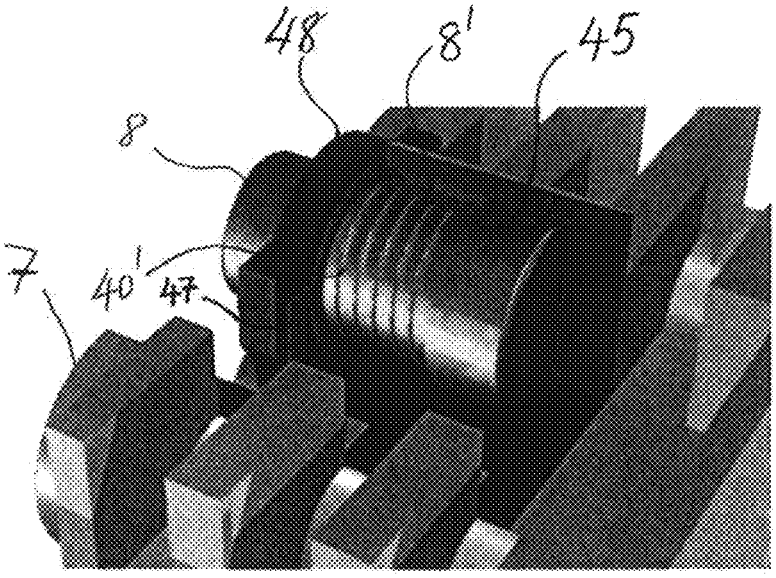
FIGS. 9A and 9B show a variant embodiment of a socket innard sub-assembly.
Figure 9B:
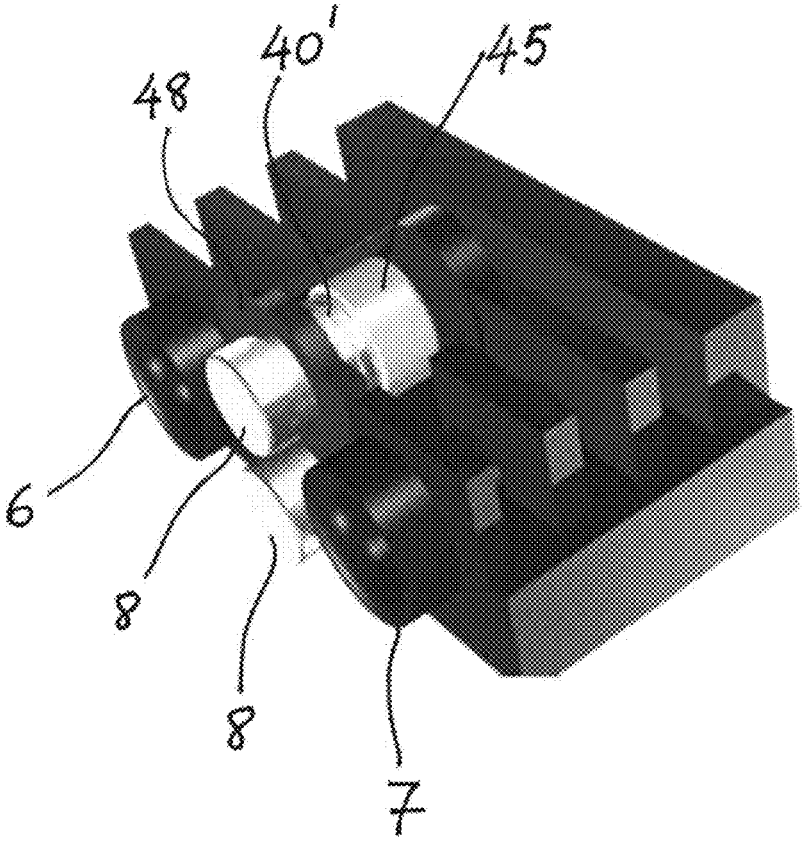

FIGS. 9A and 9B show a potted magnet arrangement which comprises a coil spring. In this embodiment the 'bucket' 45 houses a magnetised portion 8', which is rearward of the electrically conductive contact 8. Electrical signals are carried to/from the electric contact 8 to terminals in the innard sub-assembly by way of electrically conductive tracks 47, provided on a printed circuit board substrate 48.

Referring back to FIG. 8, it can be seen that the inward facing configuration of the housing 25 is such as to constrain translational movement of each of the contacts 8 in a space between the inner surface of the housing 25 and opposing surface of the innard sub-assembly.

FIG. 9 shows a variant sprung carrier arrangement in which a coil spring 40 is attached directly to the back of each of the contacts 8 by adhesive, or by snapping onto a pip or by attaching to a metal (steel) carrier attached to the rear of the magnet. The opposite end of the spring is then attached to a contact provided by the circuit board 35.

The socket 10 comprises an electrical contact arrangement which comprises the two magnetised electrical contacts 8 which are located substantially centrally of the apertures 6 and 7. The electrical contacts 8 are spaced-apart in a direction which is substantially orthogonal to the direction of spacing of the apertures 6 and 7. One of magnetised electrical contacts is a North pole forward facing surface, which the other magnetised electrical contact 8 provides a South pole forward facing surface. The contacts 8 are displaceably retained in the forward surface or interface 24 of the socket. The magnetisation of the contacts serves, in use, to provide a retaining force to assist in retaining the plug in a connected condition with the socket. However, the retaining force provided by the magnetisation is not so large as to prevent the plug from being disengaged from the audio jack socket. The electrical contacts 8 are arranged to electrically interface with electrical contacts 3 of the plug 1 by way of a face-to-face or intimate contact. It will be appreciated that although the magnetic contacts 8 could each be a single (ferrous) magnetised piece of electrically conductive material such as Fe, in other embodiments it may comprise a two part construction, comprising a first portion which is electrically conductive and intended to conduct electrical signals and a second part which is a magnetic, in which the first distinct portion serves primarily to conduct electric signals and the second part serves to provide the magnetic attraction. For example the first portion may be a centrally located and the second portion being of annular shape surrounding the first portion or vice versa. The two parts may form distinct layers, one on top of the other.

Advantageously, the electrical contacts 8 are retained in position by virtue of the locating by the annular formations 31 of the sprung carrier 30. This avoids the need to solder the electrical contacts in position (which can deteriorate the magnetic field strength of the electrical contacts as a result.)

The apertures 6 and 7, and the magnetised electrical contact 8 are set in an electrically insulative portion 14, which maintains those features electrically insulated from each other.

The plug 1 is connected to an audio headset by way of the cable 20.

Figure 2:
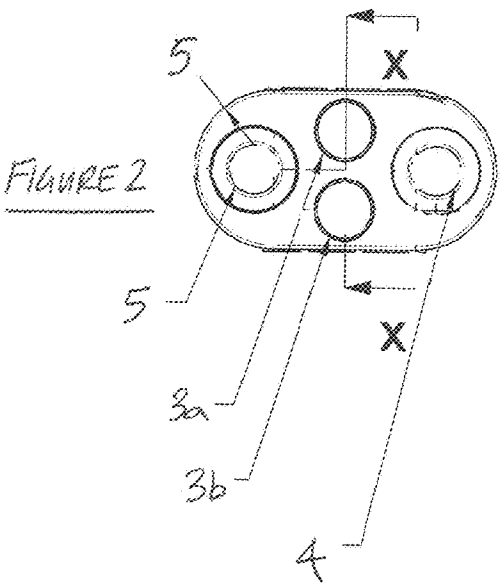
FIG. 2 is a front elevation of the electrical plug of FIG. 1.
Figure 3:
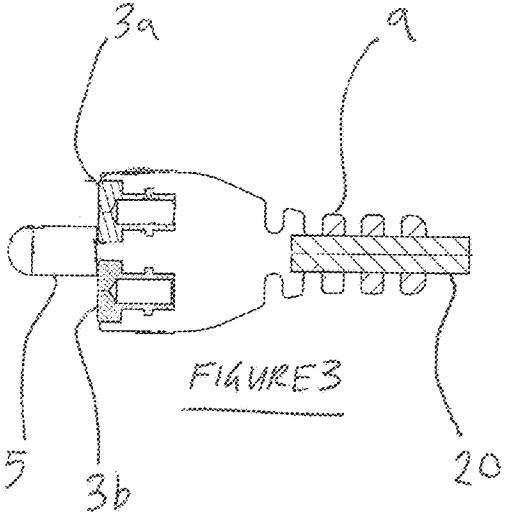
FIG. 3 is a longitudinal cross-section on X-X of the electrical plug of FIGS. 1 and 2.
Figure 8:
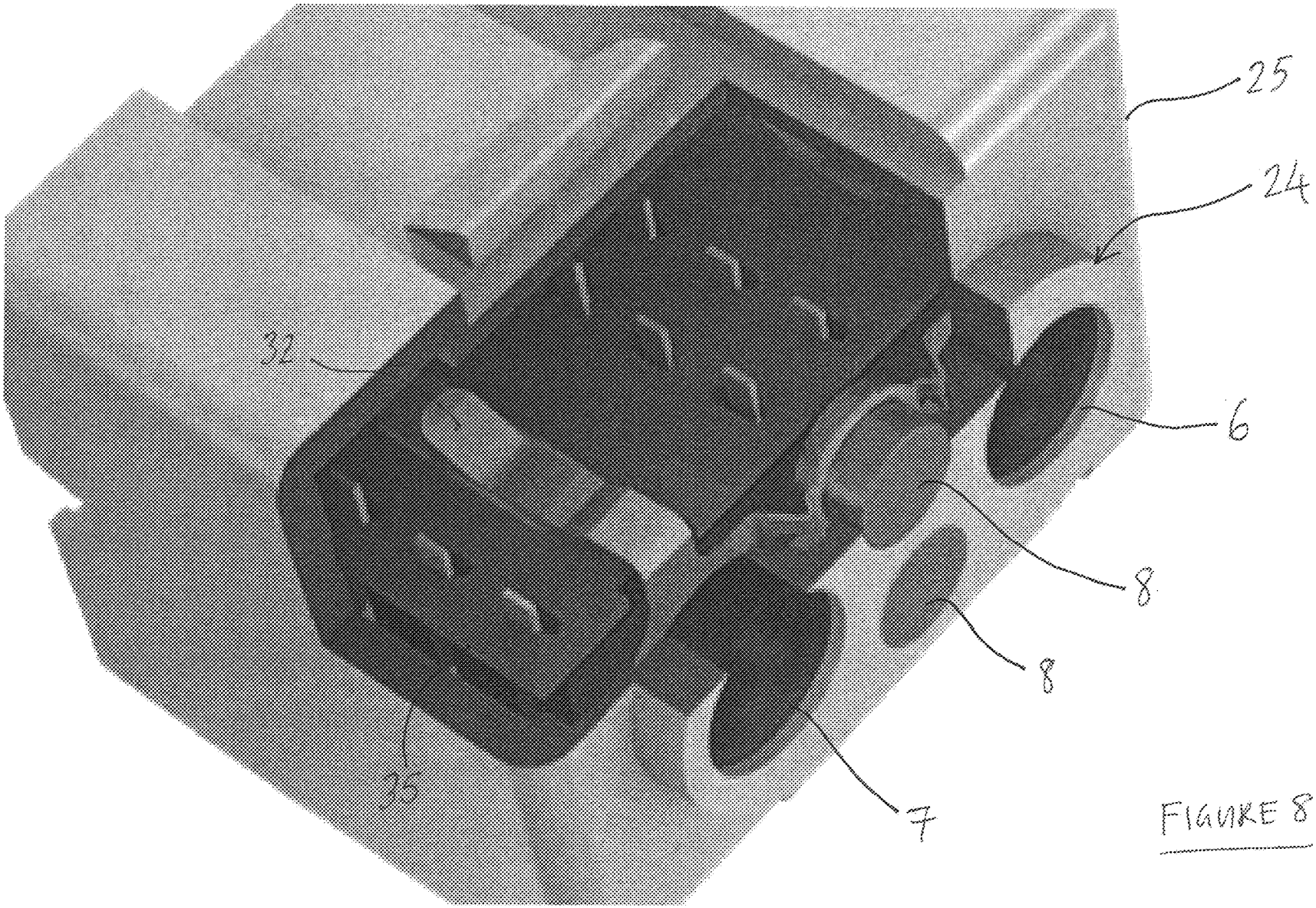
FIG. 8 is a perspective view of an electrical socket comprising the innard of FIG. 7 and an external housing.
Figure 11:
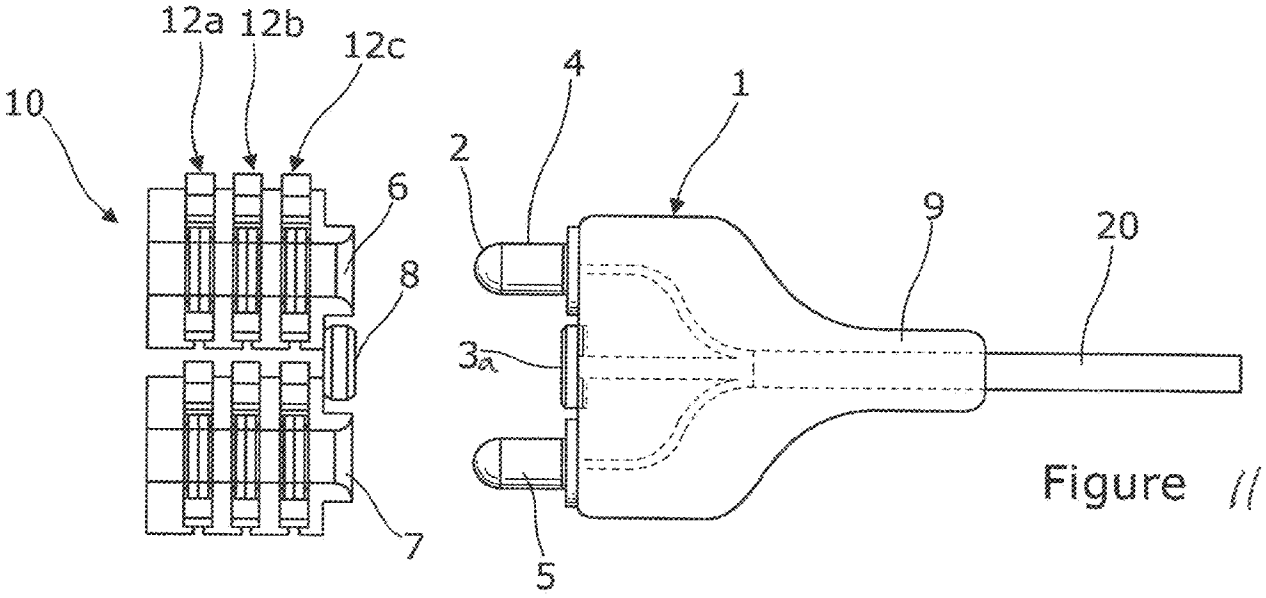
FIG. 11 is a plan view of a plug and a socket.

Reference is made to FIGS. 7, 8 and 9. The socket 10 comprises electrical cable/wiring which connects to a source of audio drive signals from an on-board passenger entertainment system. Inside each of the apertures 6 and 7 there are provided a number of electrical terminals, spaced along the lengths of the recessed regions in the socket, and arranged to contact with respective contact regions of pins of an electrical plug. As can be seen in FIGS. 7 and 11, each of the electrical contacts inside the socket is shown by reference numerals 12*a*, 12*b* and 12*c*, which are spaced along the depth of each of the respective parts of the socket. The contacts are arranged to contact with different conductive portions of plugs inserted therein, dependent on the length of the pin(s). It can also be seen from FIG. 2, as shown in broken line, the wiring within the housing of the plug to each of the pins 4 and 5 and to the contact 3.

In use, the socket 10 is installed in or adjacent to passengers' seating in an aircraft. Should the passenger wish to use the onboard entertainment system, he can push the plug 1 (of his audio headset) into the socket 10. In so doing, the pins 4 and 5 are received in the respective apertures 6 and 7, and the contacts 3*a* and 3*b* are received (in electrical connection) with the electrical contacts 8 in face-to-face contact, and held together by magnetic attraction. Without the plug 1 attached to the socket 10, the forward-facing surfaces of the electrical contacts 8 are substantially flush with the interface 24 of the outer housing 25. This positioning of the contacts 8, in a detached, unconnected condition, is achieved by the sprung carrier acting on the shoulder of each contact 8, on the sprung carrier's undeflected condition. On bringing the contacts 3*a* and 3*b* in register with and close proximity to respective contacts 8, the magnetic attraction force cause the contacts 8 to translate, outwardly against a restoring force of the sprung carrier. When connected and attached, the outward facing surfaces of each of the contacts 8 is held in intimate, face-to-face contact with its counter-part contact surface 3*a* and 3*b*, respectively. In this condition, each of the electrical contacts 8 is maintained slightly protruding from the interface 24, against a restoring force applied by the sprung carrier.

A magnetic attraction force exists between the socket and the plug. This ensures that whilst in use the plug 1 is maintained connected to the socket 10. The force required to overcome the magnetic attraction and cause the plug to become detached from the socket is approximately 5N. It will be appreciated that this detachment force is greater than the restoring spring force applied by the sprung carrier. In the event that the user inadvertently, whilst wearing the headset, moves beyond the length of the cable, this will cause a pulling force to be applied to the plug 1. This may come about as a result of the user attempting to get up out of his seat, but forgetting to remove the headset before doing so. With conventional plugs this would result in potentially damaging forces being applied to the headset, the cable and the plug since the plug would be retained in the socket. However, with the plug 1, the lengths of the pins 4 and 5 received by the socket, and the strength of the magnetic retaining force, are such that when such a pulling force is applied to the plug, the plug is disengaged from the socket, in a quick-release manner, and thereby minimising the potentially damaging forces which could be applied. Advantageously, even if the pulling force is applied at a high angle to the plug (ie not aligned with the longitudinal axes of the pins and thereby reducing the pulling force/vector component), the plug will nevertheless become disengaged. The quick-release process is assisted by the effective length of cable entry sleeve 9, which causes a leverage to be applied to the plug, thereby further facilitating the disengagement. In this way, the pins 4 and 5 are pivoted out of their respective socket recesses. The cable entry sleeve 9 may be of semi-rigid or flexible construction.

Figure 12:
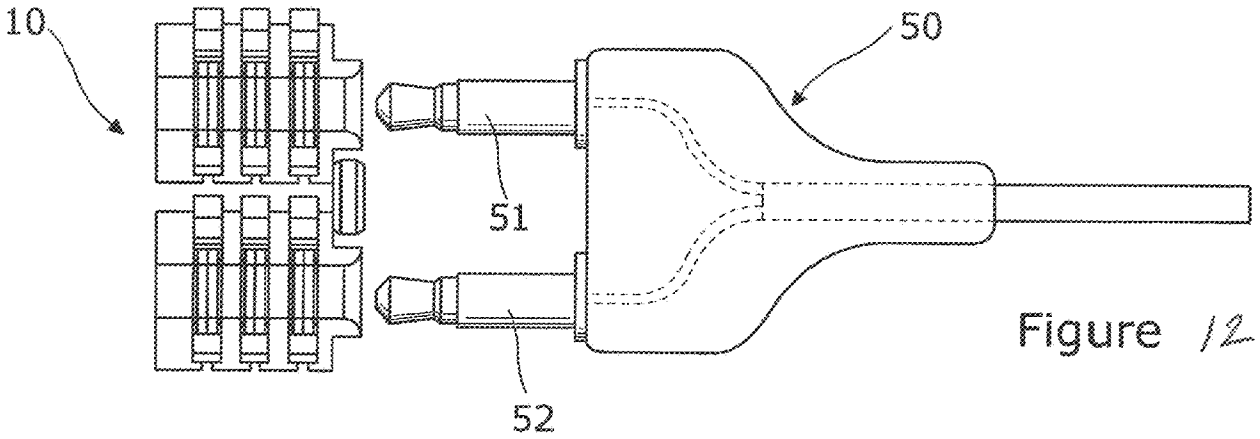
FIG. 12 is a plan view of a plug and socket.

Advantageously, the socket 10 is backwards compatible in that it is capable of also allowing a known plugs (with electrical pins) to be used therewith, for example of the type which comprise a pin in which the various terminals are spaced along the length of the pin (and electrically isolated from each other). Reference is made to FIGS. 11 and 12 in this regard. On insertion of such a known plug type, the, or each, of the terminals of the (known) pin will contact a respective terminal contact located internally of the apertures. The socket 10 therefore has the versatility to accept the plug 1 or a known plug type, and so is not restricted to use of the former. By way of example, FIG. 12 shows a known 'standard' two-pin plug 50, in which each of the two pins 51 and 52 thereof comprises two electrical contacts (a sleeve contact and a tip contact, electrically insulated from each other). Advantageously, the socket 10 is capable of receiving such a plug, and being fully operational therewith. The socket 10 is also compatible with single pin plugs (such as a 3.5 mm stereo plug). In order to achieve this multi-plug compatibility, the wiring of the terminals within the socket is arranged so that signals from multi-contact pins (be they of a single pin plug or a two pin plug) are correctly routed. When the pins 51 and 52 are inserted into the socket 10, each of the tip and sleeve portions of each pin, will be brought into electrical contact with each of socket contacts 12*c* and 12*b*. When the plug 1 is inserted into the socket 10, each of the pins 4 and 5, will contact with only internal terminals 12*c*, of each respective socket recess.

Figure 13:
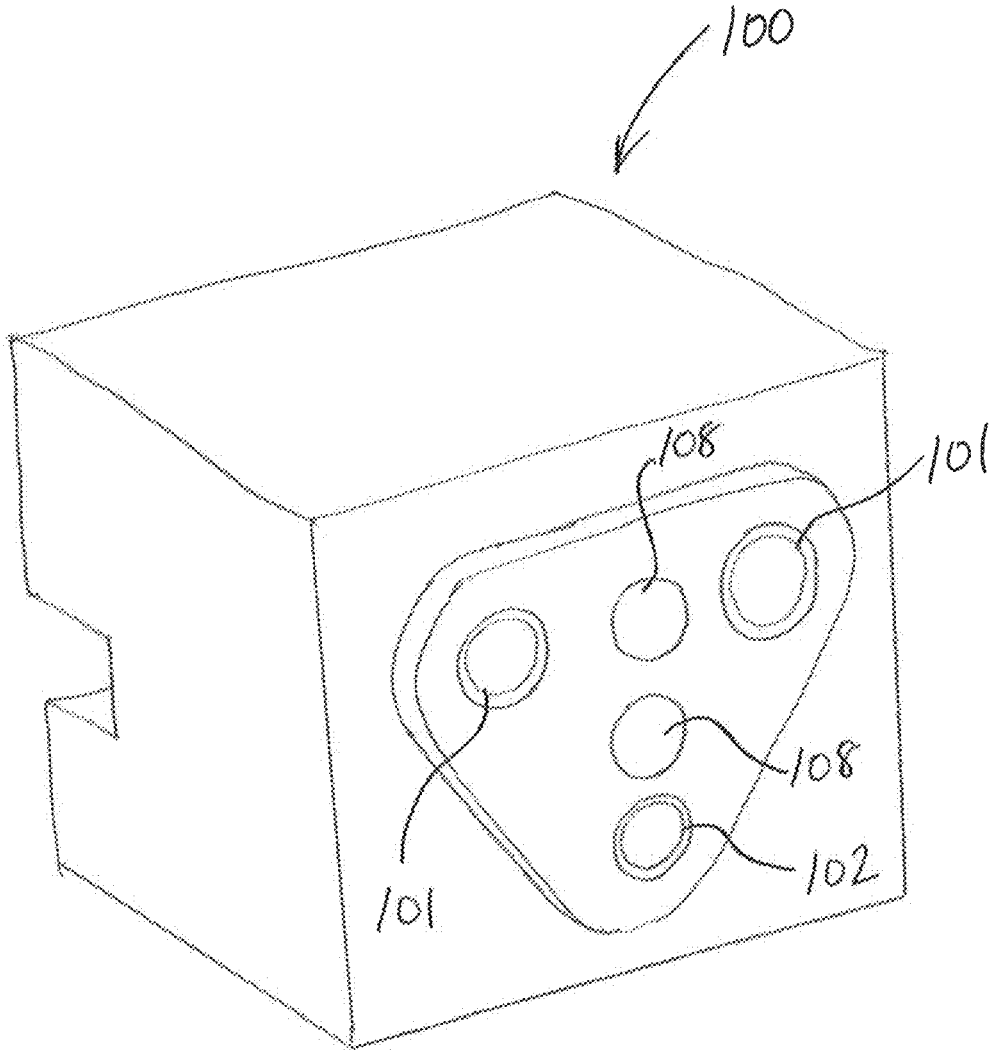
FIG. 13 shows a variant socket.

In a variant embodiment of the socket 10, three pin-receiving recesses may be provided, arranged in a generally triangular arrangement, with the electrical contacts 8 provided in a region of the interface of the plug which is intermediate thereof. An example of such an embodiment 100 is shown in FIG. 13 in which the features 101 and 102 are the pin receiving apertures and features 108 are the magnetic electrical contacts.

Figure 14:
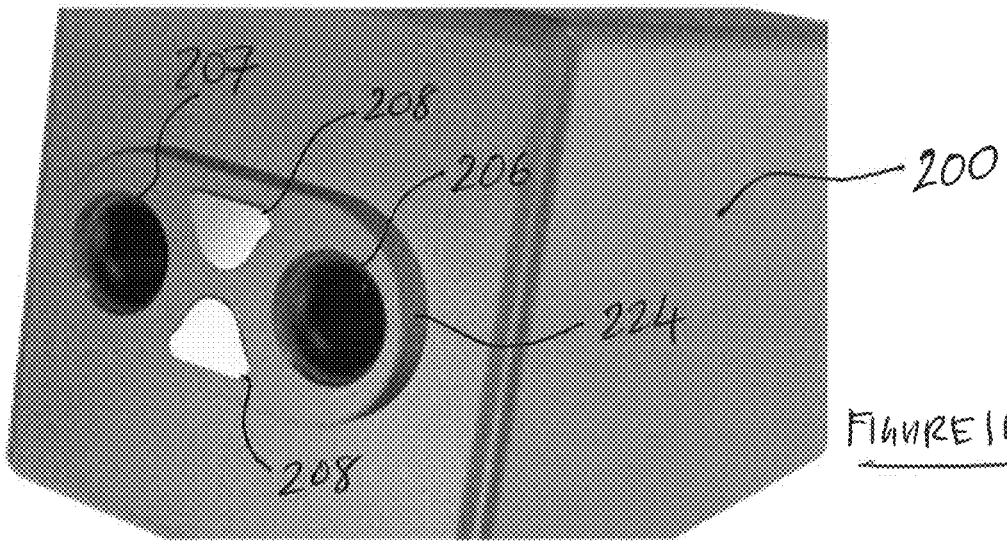
FIG. 14 shows a further embodiment of the invention, having two custom shaped electrical contacts and electrical pin receiving recesses.
Figure 15:
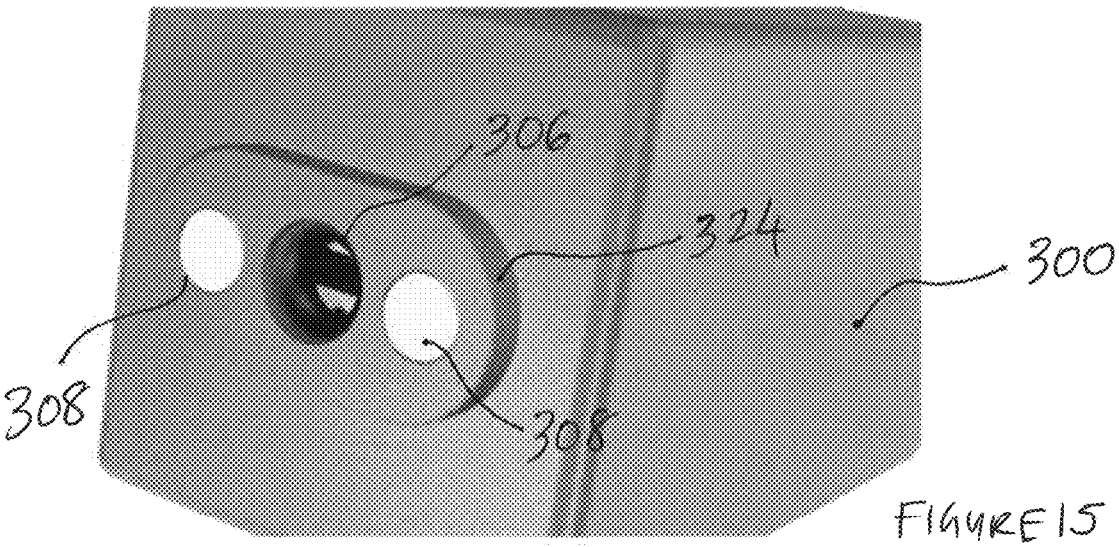
FIG. 15 shows another embodiment of the invention, having a single electrical pin receiving recess flanked by two spaced-apart magnetic electrical contacts.
Figure 16:
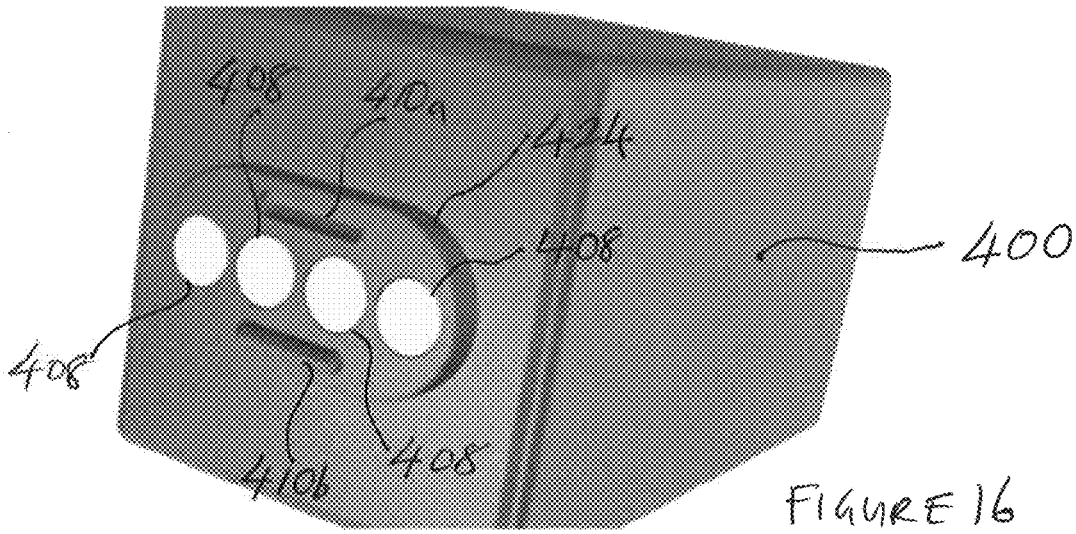
FIG. 16 shows yet another embodiment of the invention, having four spaced-apart magnetic electrical contacts, a locating detent, and a locating recess.

Reference is made to FIGS. 14, 15 and 16 which show further variant embodiments of the socket, but all-encompassing the underlying functionality of magnetically attractive electrical contacts which serve both to retain a plug to the socket, and to carry electrical signals. In FIG. 14, the socket 200 comprises two custom shaped electrical contacts 208, provided on an interface 224, and further comprising electrical pin receiving recesses 206 and 207. FIG. 15 shows a socket 300 which comprises a single electrical pin receiving recess 306 which is flanked by two spaced-apart magnetic electrical contacts 308 provided on an interface 324. Finally, FIG. 16 shows a socket 400 which comprises an interface 424 which itself comprises four spaced-apart magnetic electrical contacts 408. The interface 424 further comprises a locating detent 401*a* and a locating recess 410*b*. FIGS. 410*a* and 410*b* are arranged to engage with counterpart formations on a counterpart connector, which itself also comprises four electrical connectors, arranged to be magnetically attracted to the electrical contacts 408.

Although the above embodiment finds particular application in the field of headphones (and is of particular advantage in the field of (inflight or otherwise) passenger entertainment), modified embodiments also find application in relation to plug and socket arrangements for transmission of data generally, or indeed any electrical signal, and not solely audio signals and/or power. This may be achieved by providing a connection between at least two of the contacts of each aperture of the socket so that electrical signals are correctly routed for each of the different plug types which are compatible with the socket 10.

The invention claimed is:

1. An electrical connector comprising two first electrical contacts which provide an electrical connection for a counterpart electrical connector, the first electrical contacts arranged to interface with counterpart electrical contacts of the counterpart electrical connector, and said first electrical contacts arranged to be magnetically retained to the counterpart electrical connector when attached to the connector, and being arranged to provide an electrical connection to the counterpart electrical connector, wherein each of the first electrical contacts is mounted for translational movement relative to a body of said electrical connector, said first electrical contacts arranged to allow for and permit translational movement when connected to the counterpart electrical connector, said electrical connector further comprising an electrically conductive sprung carrier arranged to provide a counter-force to at least one direction of translational movement of at least one of said first electrical contacts and said second electrical contacts and to electrically connect said at least one of said first electrical contacts and said second electrical contacts to an interior of said electrical connector;

each of the first electrical contacts comprises an interface surface arranged for face-to-face electrical contact with respective electrical contacts of the counterpart connector, and further wherein each of the first electrical contacts is a magnet, and the connector further comprises one or two electrical pin receiving recesses, which contain respective second electrical contacts, which are arranged to be brought into electrical connection with one or two pins of the counterpart connector when the pins are received in the recesses, and in use both the first electrical contacts and the second electrical contacts of the connector arranged to transmit or receive respective electrical signals to or from respective electrical contacts in the counterpart electrical connector when the counterpart electrical connector is connected.

2. The electrical connector as claimed in claim 1 in which each of the first electrical contacts comprises a substantially flat surface arranged to interface with the counterpart electrical connector.

3. The electrical connector of claim 1 in which each of the first electrical contacts arranged to carry an electrical signal.

4. The electrical connector of claim 1 in which each of the first electrical contacts comprises a substantially flat surface arranged to be brought into intimate contact with each of the counterpart electrical contacts of the counterpart electrical connector.

5. The electrical connector of claim 1 in which the first electrical contacts arranged to carry at least one of audio signals, data signals, drive signals and return signals.

6. An electrical connector as claimed in claim 1 in which the first electrical contacts arranged to permit an extent of translational movement when connected to the counterpart electrical connector.

7. An electrical connector as claimed in claim 1 in which the sprung carrier provides electrical connection by way of an electrically conductive pathway from the electrical contact.

8. An electrical connector as claimed in claim 1 in which the sprung carrier is arranged such that, in use, on initiating connection with a counterpart electrical connector, the electrical contacts are translated against a spring force.

9. An electrical connector as claimed in claim 8 in which the sprung carrier is arranged to provide a restoring force to the electrical contacts when the counterpart electrical connector is decoupled/detached from the connector, the electrical contacts are urged to translate inwardly of the interface of the connector.

10. An electrical connector as claimed in claim 1 in which the first electrical contacts are spaced apart.

11. An electrical connector as claimed in claim 1 in which the first electrical contacts each comprises a substantially cylindrical formation or substantially cylindrical portion.

12. An electrical connector as claimed in claim 1 in which the first electrical contacts comprise an electrically conductive magnetic or magnetised material.

13. An electrical connector as claimed in claim 1 wherein said electrical connector comprises an electrical socket.

14. An electrical connector as claimed in claim 1 wherein said electrical connector comprises an electrical plug.

15. The electrical connector of claim 1 which comprises an electrical socket and which is arranged to be compatible with both a two-pin electrical plug and a single pin electrical plug.

16. An electrical connector comprising an electrical plug for electrical equipment comprising a housing and at least one electrical pin extending from an interface of the housing for receipt by a socket and for electrical connection therewith, and the plug further comprising two electrical contacts also arranged for electrical contact with the socket, wherein the at least one electrical pin is longer than the electrical contacts, wherein the at least one electrical pin and the two electrical contacts arranged to facilitate disengagement of the plug from said socket, and further wherein the electrical contacts comprise magnets magnetically attract to the socket and thereby provide a magnetic retaining force between the plug and the socket, and the electrical contacts arranged to carry an electrical signal to or from respective electrical contacts in the socket when the counterpart electrical connector is connected to said socket, said electrical connecter further comprising an electrically conductive sprung carrier arranged to provide a counter-force to at least one direction of translational movement of said two electrical contacts and to electrically connect said two electrical contacts to an interior of said electrical connector.

17. An electrical connector as claimed in claim 16 in which the electrical contacts are substantially flat.

18. An electrical connector as claimed in claim 16 in which the electrical contacts are of substantially negligible length.

19. An electrical connector as claimed in claim 16 in which two electrical pins are provided and they are of substantially the same length.

20. An electrical connector as claimed in claim 16 in which each of the electrical contacts comprises a respective metal plate.

21. An electrical connector as claimed in claim 16 in which the electrical contacts arranged to provide a face-to-face connection contact with the socket.

22. An electrical connector as claimed in claim 16 in which the at least one electrical pin is arranged to provide return signal connections.

* * * * *